US008823763B2

(12) United States Patent
Shikina

(10) Patent No.: US 8,823,763 B2
(45) Date of Patent: Sep. 2, 2014

(54) EXPOSURE HEAD OF A PRINTING APPARATUS

(71) Applicant: Canon Kabushiki Kaisha, Tokyo (JP)

(72) Inventor: Noriyuki Shikina, Ichihara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/671,301

(22) Filed: Nov. 7, 2012

(65) Prior Publication Data

US 2013/0120516 A1 May 16, 2013

(30) Foreign Application Priority Data

Nov. 10, 2011 (JP) ..... 2011-246715

(51) Int. Cl.
*B41J 2/45* (2006.01)

(52) U.S. Cl.
USPC ..... 347/238

(58) Field of Classification Search
USPC ..... 347/229, 235–238, 247–250
See application file for complete search history.

(56) References Cited

U.S. PATENT DOCUMENTS

| | | | | |
|---|---|---|---|---|
| 4,743,927 | A * | 5/1988 | Sasaki | 347/130 |
| 5,040,003 | A * | 8/1991 | Willis | 347/118 |
| 2006/0187292 | A1 * | 8/2006 | Matsuzaki et al. | 347/111 |
| 2007/0103539 | A1 * | 5/2007 | Seo | 347/230 |

FOREIGN PATENT DOCUMENTS

JP 2006-346871 A 12/2006

* cited by examiner

*Primary Examiner* — Hai C Pham
(74) *Attorney, Agent, or Firm* — Canon USA Inc IP Division

(57) ABSTRACT

Provided is printing apparatus which includes: a light-emitting device array and a photoconductor, wherein the light-emitting device array includes the light-emitting devices of the number greater than the number of pixels of a single line of the print image, data of the single line of the print image are allocated to a portion of the light-emitting devices in the light-emitting device array, and in a period in which exposure of the photoconductor is halted, the light-emitting devices to which the data of the single line of the print image are allocated are shifted in position in the light-emitting device array.

13 Claims, 7 Drawing Sheets

FIG. 5

| PRINT PAGE | PRINT LINE NUMBER | EFFECTIVE PIXEL IN ORGANIC EL ARRAY 21 | | |
|---|---|---|---|---|
| 1 | 1 | 1 | ··· | 4728 |
| | 2 | 1 | ··· | 4728 |
| | ⋮ | ⋮ | ⋮ | ⋮ |
| | 6785 | 1 | ··· | 4728 |

SHIFT EFFECTIVE AREA

| PRINT PAGE | PRINT LINE NUMBER | EFFECTIVE PIXEL IN ORGANIC EL ARRAY 21 | | |
|---|---|---|---|---|
| 2 | 1 | 2 | ··· | 4729 |
| | 2 | 2 | ··· | 4729 |
| | ⋮ | ⋮ | ⋮ | ⋮ |
| | 6785 | 2 | ··· | 4729 |

SHIFT EFFECTIVE AREA

⋮

SHIFT EFFECTIVE AREA

| PRINT PAGE | PRINT LINE NUMBER | EFFECTIVE PIXEL IN ORGANIC EL ARRAY 21 | | |
|---|---|---|---|---|
| n | 1 | n | ··· | 4727 + n |
| | 2 | n | ··· | 4727 + n |
| | ⋮ | ⋮ | ⋮ | ⋮ |
| | 6785 | n | ··· | 4727 + n |

EXPOSURE HEAD OF A PRINTING APPARATUS

BACKGROUND OF THE INVENTION

1. Field of the Invention

The present invention relates to a printing apparatus. More particularly, the present invention relates to electrophotographic printing apparatus, such as copiers and printers.

2. Description of the Related Art

In some electrophotographic printing apparatus, light-emitting devices, such as light emitting diodes and organic electroluminescence devices, are arranged linearly and are used as an exposure head. In such electrophotographic printing apparatus, a photoconductor surface is irradiated with light emitted by a light-emitting device array via a lens array, and a latent image is formed on the photoconductor surface by repeated exposure cycle in accordance with moving speed of the photoconductor. This exposure system differs from an exposure system in which a photoconductor is scanned with laser light using a polygon mirror. Use of the light-emitting device array helps reduce the size and noise of the printing apparatus.

The organic EL device has a characteristic that brightness thereof decreases after a long period of use. In a case in which brightness of the entire organic EL device array decreases uniformly, print quality is not seriously affected even after the brightness is decreased by about 10%. However, repeated printing with some organic EL devices emitting light for a longer time than others causes variation in degrees of brightness decrease in accordance with the position in the array. This causes stripe-patterned unevenness on print images and results in decrease in print quality even if brightness decrease is as small as 1% to 5%.

Japanese Patent Laid-Open No. 2006-346871 describes an invention related to printing apparatus including an LED array as an exposure head: in which printing apparatus, plural LED arrays are used sequentially one at a time when brightness of currently used one is decreased.

Life of each light-emitting device array is limited. Therefore, in such printing apparatus in which plural light-emitting device arrays are provided, increase in life of the entire light-emitting device arrays is achieved only by increasing the number of light-emitting device arrays. However, the number of light-emitting device arrays is not able to be increased greatly because the light-emitting device array forms an image on a photoconductor using a rod lens array and thus the number of light-emitting device is limited by the range of aperture of the rod lens array.

An electrophotographic printing apparatus having light-emitting devices as an exposure head in which a life of the exposure head is prolonged and thereby print quality is improved has been desired.

SUMMARY OF THE INVENTION

An example of the present invention is a printing apparatus comprising a light-emitting device array in which plural light-emitting devices are arranged and a photoconductor which moves in a direction perpendicular to the direction in which the light-emitting devices are arranged, in which light emitted by the light-emitting devices exposes the photoconductor to form a print image on the photoconductor, wherein the light-emitting device array includes the light-emitting devices of the number greater than the number of pixels of a single line of the print image, data of the single line of the print image are allocated to a portion of the light-emitting devices in the light-emitting device array and turn-off signals are allocated to the remaining light-emitting devices in the light-emitting device array, and in a period in which exposure of the photoconductor is halted, the light-emitting devices to which the data of the single line of the print image are allocated are shifted in position in the light-emitting device array.

According to an exemplary configuration of the present invention, since light-emission frequency of the light-emitting devices is distributed and thus is averaged, local brightness decrease is reduced and life of the exposure head is prolonged.

Further features of the present invention will become apparent from the following description of exemplary embodiments with reference to the attached drawings.

BRIEF DESCRIPTION OF THE DRAWINGS

FIG. 5 is a diagram illustrating specification of print image data input in the organic EL array according to the first embodiment.

DESCRIPTION OF THE EMBODIMENTS

Hereinafter, embodiments of the printing apparatus according to an example of the present invention will be described with reference to the drawings. Common or known techniques are applied to the portions which are not especially illustrated or described. A range to which the present invention is applied is not limited by the number and arrangement pitch of organic EL devices in an organic EL array described in the following embodiments, and may be changed suitably in accordance with specification of the printing apparatus. In the following description, an organic electroluminescence device (hereafter, organic EL device) is described as an example: however, the present invention is applicable to other light-emitting devices, such as an inorganic EL device, an LED and a field emission device.

First Embodiment

Figure 1:
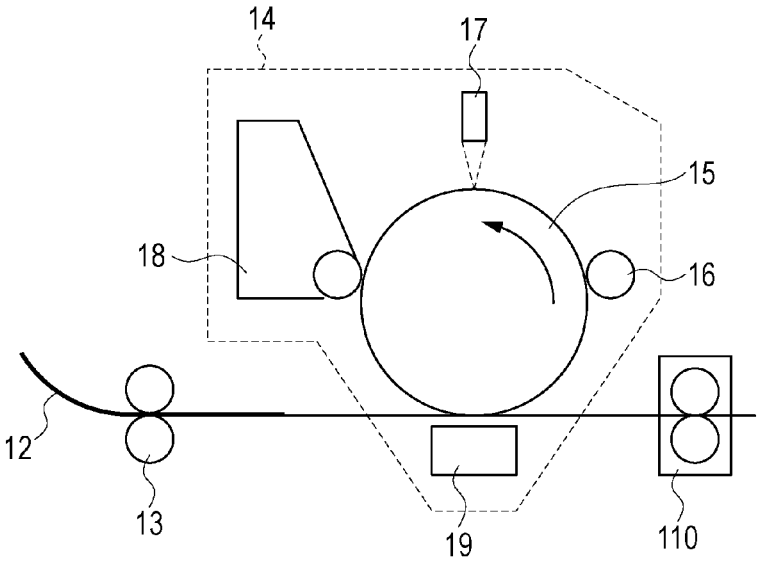
FIG. 1 is a schematic diagram of printing apparatus according to a first embodiment of the present invention.

FIG. 1 is a schematic diagram illustrating a configuration of printing apparatus which is an embodiment of the present invention.

A recording unit 14 includes a drum-shaped photoconductor 15, a charger 16, an exposure head 17, a developing unit 18 and a transfer unit 19. A photosensitive material is applied to a surface of the photoconductor 15. A surface of the photoconductor 15 is charged by the charger 16 and then exposed by light emitted by a light-emitting device array represented by an organic EL array in which organic EL devices are arranged. The organic EL array is disposed in the exposure head 17. The amount of exposure of the photoconductor is controlled by the product of illumination intensity and exposure time. At a portion of the photoconductor 15 which is exposed by the light emitted by the organic EL device, electric potential is changed and toner adheres to that portion as that portion passes the developing unit 18. A paper sheet 12 is conveyed to the recording unit 14 by a feeding roller 13 in an apparatus main body. The toner which adhered to the photoconductor 15 is transferred to the paper sheet 12 by the transfer unit 19. The toner is fixed to the paper sheet 12 in a fusing unit 110 and the printing is completed. A color image may be obtained in a configuration in which plural recording units 14 each including toner of different colors are arranged in series, and the toner of different colors is sequentially transferred to the paper sheet 12.

Figure 2:
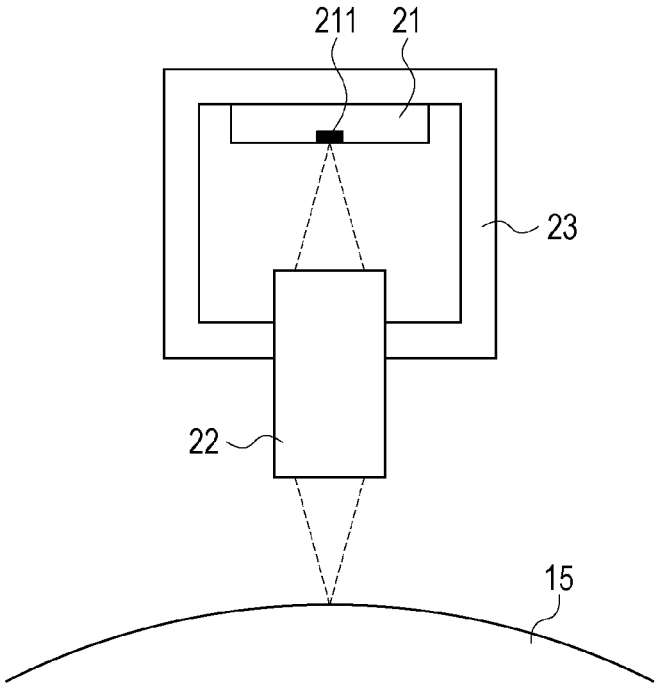
FIG. 2 is a schematic diagram of an exposure head according to the first embodiment.

FIG. 2 is a schematic diagram of the exposure head 17.

In the exposure head 17, an organic EL array 21 and a lens array 22 are fixed at certain distance to a housing 23. The organic EL array 21 includes plural organic EL devices 211 arranged in the direction vertical to the paper of FIG. 2. The organic EL devices are arranged in the direction parallel to an axis of rotation of the photoconductor 15.

The lens array 22 includes multiple rod lenses 221 arranged in parallel to the organic EL devices 211. The lens array 22 is disposed between the organic EL devices 211 and the photoconductor 15, and the light emitted by the organic EL devices 211 forms an image on the surface of the photoconductor 15 via the rod lenses 221. The number of the rod lenses 221 in the lens array 22 is not necessarily the same as the number of organic EL devices 211. However, it is desirable that the length of the lens array 22 is the same as that of the organic EL array 21 so that the light emitted by all of the organic EL devices 211 enters the lens array 22.

Figure 3:
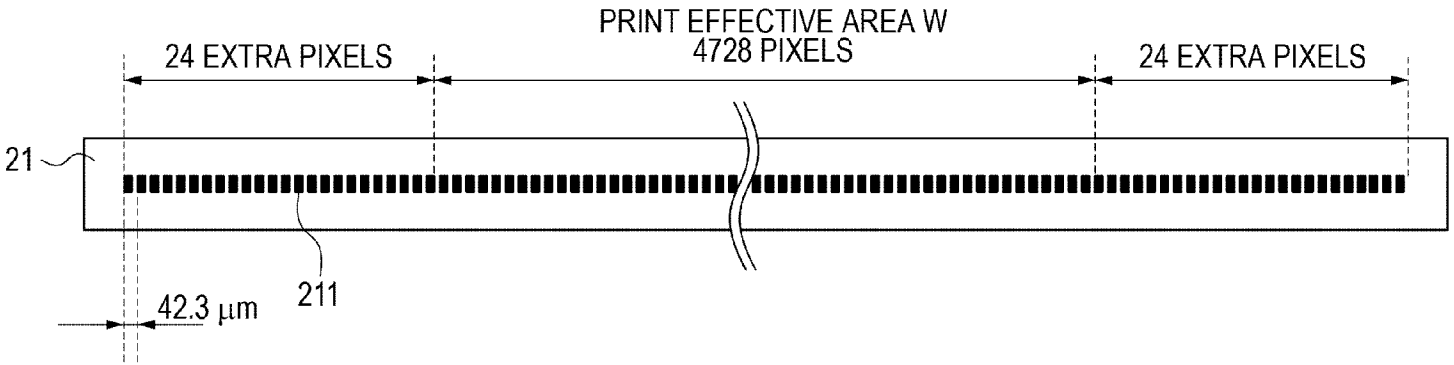
FIG. 3 is a plan view of an organic EL array according to the first embodiment.

FIG. 3 is a plan view of the organic EL array 21 seen from the side of a light-emitting surface thereof.

4776 organic EL devices 211 are arranged in the organic EL array 21. The organic EL devices 211 are arranged at an arrangement pitch of 42.3 μm and are capable of forming fine images of 600 dpi. The surface of the photoconductor 15 is moved in a direction perpendicular to the direction in which the organic EL devices 211 are arranged. The organic EL array 21 repeats exposure on the photoconductor 15 at the pitch of 42.3 μm in the same direction as an array direction as the photoconductor 15 is moved.

Print image data is input in the organic EL array 21. The print image data is binary or multi-value digital data for each pixel obtained by decomposing the print image into matrix pixels. The print image is input in the organic EL array 21 for each line of the matrix. When a line of data is input, the organic EL devices emit light and expose the photoconductor 15. Between the successive input of the data for each line, the photoconductor 15 is moved and the light emitted in accordance with the print image data exposes the photoconductor 15. Thus, an electrostatic latent image is formed on the photoconductor 15.

Exposure time per line is determined by the process speed. In order to print on a page of an A4-sized (210 mm×297 mm) paper sheet in four seconds, it is necessary to make exposure in about 600 μs per line. This exposure time corresponds to emission time of each light emission event of the organic EL array. Exposure is repeated for each of 6785 lines along the long side of an A4-sized paper sheet.

Figure 4:
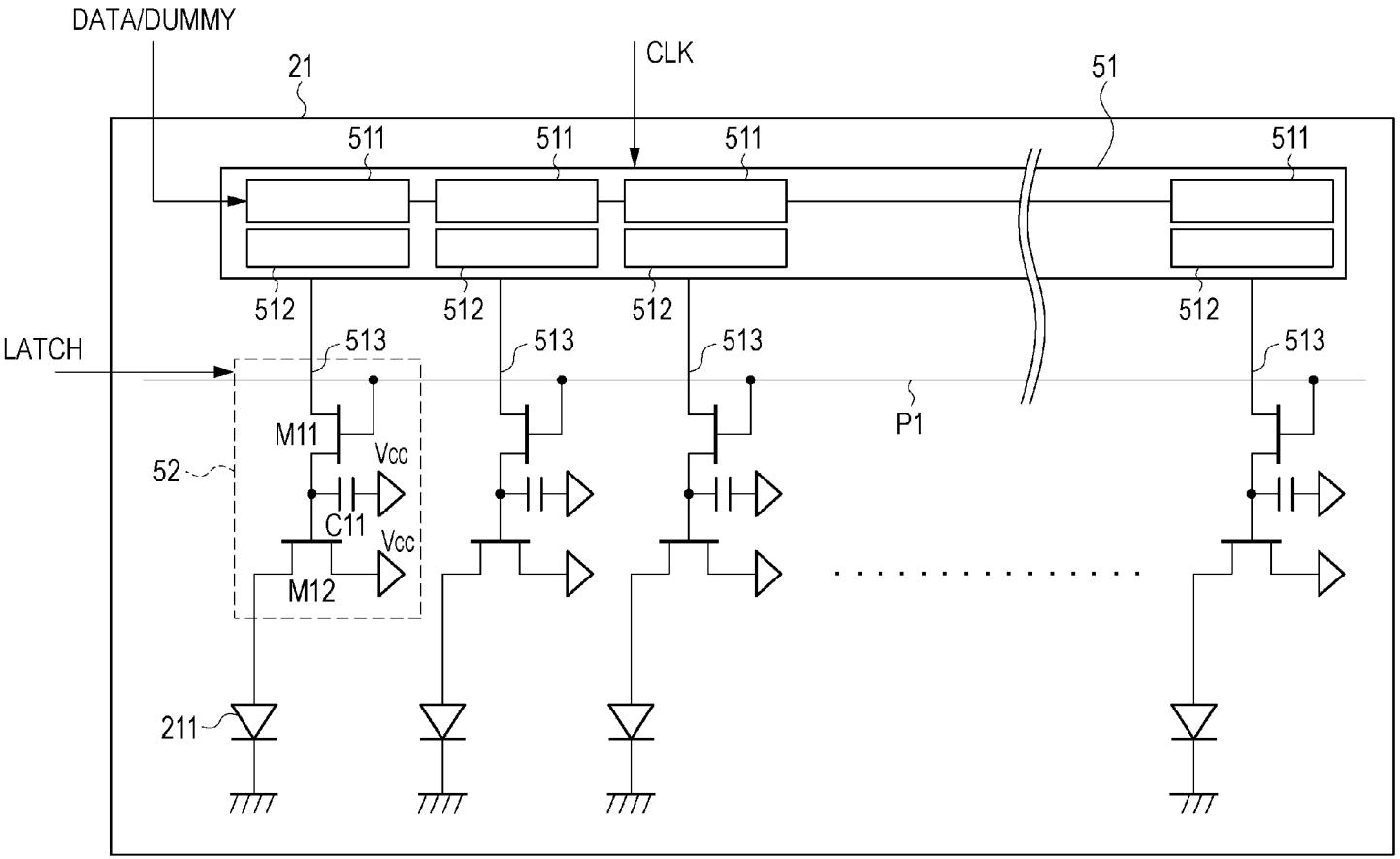
FIG. 4 is a circuit diagram of the organic EL array according to the first embodiment.

FIG. 4 is a diagram illustrating a circuit of the organic EL array 21. The organic EL array 21 includes, in addition to the organic EL devices 211, driving circuits 52 and a signal transformation circuit 51. The number of the driving circuits 52 is the same as the number of organic EL devices 211. The signal transformation circuit 51 sends input data signals to each driving circuit.

Data signals of a print image are input in the signal transformation circuit 51 for each line. The signal transformation circuit 51 converts data signals input as serial signals into parallel signals, then converts the parallel signals into suitable voltage, and outputs the voltage to information lines 513. The signal transformation circuit 51 includes a shift register 511 and a D/A (digital/analog) converter 512.

The information lines 513 are connected to the driving circuits 52.

Each of the driving circuits 52 includes two transistors M11 and M12, and retention volume C11. A source of the transistor M11 is connected to the information line 513, a gate of the transistor M11 is connected to a latch signal line P1, and a drain of the transistor M11 is connected to an end of the retention volume C11. A gate of the transistor M12 is connected to the drain of the transistor M11, and a drain of the transistor M12 is connected to an anode of the organic EL device 211. The source of the transistor M12 and the other end of the retention volume C11 are fixed to power supply potential Vcc.

When a latch signal LATCH is input and the level of the latch signal line P1 becomes H (high), the transistor M11 turns into a conductive state (ON) and voltage of the information line 513 is transferred to the retention volume C11. When the latch signal line P1 becomes L (low) level, the transistor M11 turns into a non-conductive state (OFF) but voltage of the retention volume C11 is maintained. The transistor M12 generates a current determined by the voltage of the retention volume C11, and supplies the current to the organic EL device 211.

In the following, a case in which printing is made on an A4-sized paper sheet in an area of 200 mm in the short side and 287 mm in the long side with 5-mm margin above, below, left and right of the printing area will be described. Since the width of the printing area (hereafter, print effective area) in the short side is 200 mm, the number of organic EL devices necessary for printing is 200 mm/42.3 μm which corresponds to 4728.

The organic EL array 21 includes 4776 organic EL devices, which number is greater than the number of organic EL devices necessary for the printing. That is, in addition to the 4728 organic EL devices for the print effective area, the organic EL array 21 includes 48 extra organic EL devices. The width of the total extra organic EL devices is about 2 mm and therefore, the full length of the arranged organic EL devices 211 is 200+2 mm.

In an example of the present invention, the position of the print effective area is changed within a single line using the organic EL array which includes the organic EL devices of the number greater than that of the pixels in the print effective area. The position of the print effective area is changed in a period in which exposure is halted, such as when the pages are changed or when margins or blank lines exists, after predetermined time is elapsed or after a predetermined amount of printing is exceeded.

FIG. 5 is a diagram illustrating a printing procedure in a case in which the print effective area is shifted by a single print effective area for each print page. Print image data DATA for the 4728 pixels of the print effective area W is input in the organic EL array 21 of FIG. 3. For the printing on the first page, the organic EL array 21 allocates the first to the 4728th pixels from the left end as the print effective area and sets the remaining pixels to be extra pixels. Turn-off signals DUMMY are provided to the extra pixels as dummy signals. This procedure is repeated for the first line to the 6785th line and the printing on the first page is completed. The position of the print effective area is not changed within a single page.

In a case in which the first to the 4728th pixels from the left end correspond to the print effective area W, print image data DATA is allocated to the first to the 4728th pixel from the left end and the remaining 48 pixels to the right end are set to be extra pixels. In this case, after the shift registers 511 are reset, the data signals DATA are input from the left end, shift clocks CLK are input from the first pixel to the 4728th pixel, and the shift clocks CLK are halted.

For the print of a subsequent page, a range of from the second pixel to the 4729th pixel corresponds to the print effective area W and the print image data DATA is allocated to these pixels. The dummy turn-off signals DUMMY are provided to the first pixel and to the 4730th to the 4776th pixels. Such allocation of data is achieved by, after the shift registers 511 are reset, the data is input from the left end, the shift clock CLK is input from the first to the 4728th pixel, the turn-off signal DUMMY is input in the left end, and then the print effective area W is shifted by a single pixel.

For the subsequent pages, the print effective area W is shifted to the right by a single pixel each time the pages are switched. For the n-th (n is an integer from 1 to 49) page, a range of from the n-th pixel to the (4728+n−1) pixel corresponds to the print effective area W. In the last 49th page, 48 pixels from the left end of a line are extra pixels and the 4728 pixels on the right side of the extra pixels correspond to the print effective area W. From the 50th page, the print effective area W is again located at the left end of the organic EL array 21 and is shifted sequentially in the same manner as described above.

Allocation of the print image data DATA and the turn-off signals DUMMY and input/halt of the shift clocks CLK for each page are performed in accordance with control signals generated by a control circuit which is not illustrated.

The length of the lens array 22 is determined to be great enough to cause all the organic EL devices 211 of the organic EL array 21 to form an image on the photoconductor 15. This allows the print effective area W to be shifted over the range from one end to the other end of the organic EL array 21.

In the above-described example, the turn-off signals DUMMY are added to the print image data DATA of a single line in the organic EL array 21. In an alternative configuration, data of all the organic EL devices 211 of the organic EL array 21 is generated in a data generation circuit (not illustrated) which is provided separately from the organic EL array 21, and the generated data is input in the organic EL array 21. In that case, in the data generation circuit, the turn-off signals DUMMY for 48 pixels are allocated and added before and after the print image data DATA in accordance with the page number. The organic EL array 21 does not have a function to halt the shift clocks CLK of the shift registers 511 and only has a function to convert the input data into parallel data and generate voltage signals.

No displacement of the print image in the page occurs if the print effective area W is shifted at the first line of a new page during the page switch and no shift is performed in the middle of the page. The print positions are displaced by up to 2 mm between the pages. However, such positional displacement may cause no serious problem since there are margins around the printing area in normal paper sheets.

Shift of the print effective area W is not necessarily performed on the page basis. Shift of the print effective area W may be performed during a period in which all the organic EL devices 211 of the organic EL array 21 are turned off and exposure of the photoconductor 15 is halted. The print effective area W may also be shifted when the exposure head 17 passes the upper and lower margins of the page. For text printing, the print effective area W may be shifted between lines.

In a case in which a printing amount in a page is small, the print effective area W is not necessarily switched on the page basis. For example, the print effective area W may be shifted after printing on two or more pages are completed. Alternatively, the print effective area W may be shifted in response to a print command from a host computer or may be shifted on the time basis, such as on a day basis.

The print effective area W may be shifted by 2 pixels or even greater number of pixels. Alternatively, the print effective area W may be shifted by a random number of pixels. Frequency of occurrence of printing displaced from the center of the paper sheet may be reduced by selecting the print effective area W such that the normal distribution is achieved about the central portion of the organic EL array.

If the thickness of a line segment which constitutes text is equal to or less than 2 mm, cumulative emission time which has been focused on a particular pixel may be distributed to neighboring 48 pixels. Therefore, brightness decrease of each pixel may be delayed. Even if the thickness of the line segment is equal to or greater than 2 mm, edge portions of a pattern may be feathered. Therefore, the featured portion is not easily recognized as unevenness. In the manner described above, print quality may be maintained for a long period of time.

In a case in which printing is performed on a paper sheet of the size smaller than the short side of the A4-sized paper sheet, it is necessary to set the print effective area W in accordance with the size of the paper sheet, and to perform shift of the print effective area W within a range of a margin of the paper sheet. In this configuration, the entire organic EL array 21 does not correspond to a shift range. In this configuration, 800 pixels at the central portion correspond to the print effective area W and a total of 24 pixels arranged on the left and right sides of the central 800 pixels are extra pixels: therefore, the organic EL devices 211 located further than the extra pixels are not used for the printing.

In the organic EL array 21 illustrated in FIGS. 3 and 4, the short side of a A4-sized paper sheet corresponds to the print effective area W. In printing apparatus for printing paper sheets of the size greater than A4, the organic EL array 21 includes a greater number of organic EL devices 211. In such an organic EL array, the number of organic EL devices 211 is increased to greater than the number of pixels in the width direction of the print effective area W, and the print effective area W is shifted in the same manner as described above.

The organic EL array 21 in the exposure head 17 may include two or more lines of the organic EL devices 211. In this case, the print effective area W of each line is shifted simultaneously.

Second Embodiment

Figure 6:
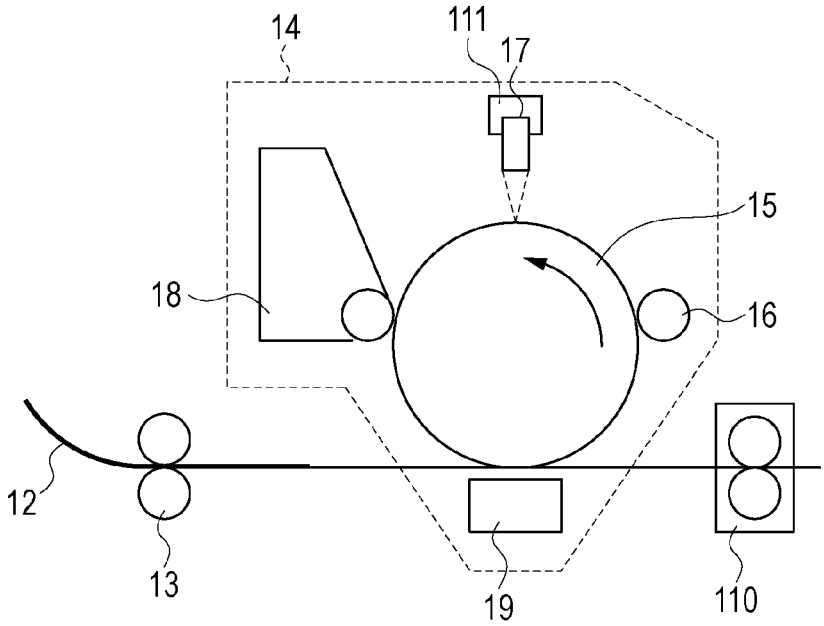
FIG. 6 is a schematic diagram of a printing apparatus according to a second embodiment of the present invention.

FIG. 6 is a schematic diagram of printing apparatus of a second embodiment of the present invention. The same constitutions as those of FIG. 1 are denoted by the same reference numerals.

The printing apparatus of FIG. 6 includes, in addition to the constitution of the printing apparatus of FIG. 1, a movement mechanism 111 of the exposure head 17. In the present embodiment, the position of the exposure head 17 and the position of the organic EL array 21 fixed to the exposure head 17 are moved at the same time the print effective area W of the organic EL array 21 is shifted. The direction in which the organic EL array 21 is moved is parallel to the direction in which the organic EL devices 211 are arranged and, at the same time, is opposite to the direction in which the print effective area W is shifted. The position of the photoconductor 15 is fixed. This allows the printing area to be fixed all the time on the paper sheet 12.

Figure 7A:
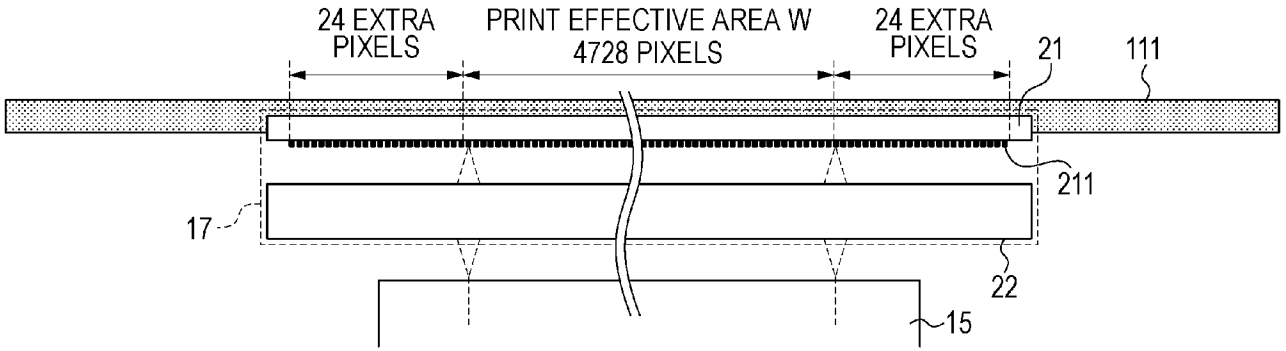
FIGS. 7A and 7B are diagrams illustrating a position of an exposure head and a position of a photoconductor according to the second embodiment.
Figure 7B:
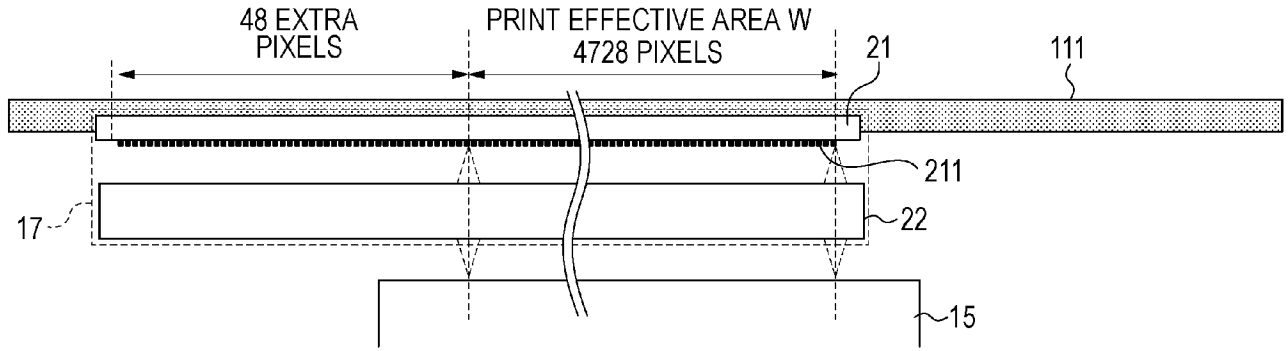

FIG. 7A illustrates a relative position of the exposure head 17 and the photoconductor 15 in a case in which the print effective area W is located at the center of the organic EL array 21. FIG. 7B illustrates a relative position of the exposure head 17 and the photoconductor 15 in a case in which the print effective area W is located at an end of the organic EL array 21.

In FIG. 7A, the print effective area W is located at the center of the organic EL array 21 and 24 extra pixels are located on both sides of the print effective area W. The photoconductor 15 and the lens array 22 are located below the print effective area W.

FIG. 7B illustrates a state in which the print effective area W is shifted to right end of the organic EL array 21 and 48 extra pixels are located on the left side of the print effective area W. The movement mechanism 111 moves the exposure head 17 and the rod lens array 22 to the left as the print effective area W of the organic EL array 21 is shifted to the right. If the distance in which the exposure head 17 and the rod lens array 22 are moved is the same as the distance in which the print effective area W is shifted, the print position on the paper sheet is not changed eventually. Since the position of the photoconductor 15 is fixed, the light emitted from the exposure head 17 in the print effective area W exposes the same position of the photoconductor 15 in both the cases of FIGS. 7A and 7B.

The print position on the paper sheet is displaced by the shift of the print effective area W in the first embodiment: however, no positional displacement occurs in the present embodiment. This allows the number of extra pixels of the organic EL array 21 to be increased and the shift range of the print effective area W to be increased regardless of the size of the margin of the paper sheet. Since pixels of greater light-emission frequency are distributed in a still wider range, life of the exposure head is further prolonged.

Instead of moving the position of the exposure head 17, a mechanism to move the paper sheet 12 in the direction parallel to the direction in which the organic EL devices are arranged may be provided. The same effect as that described above is obtained in this configuration. The paper sheet 12 is moved in the same direction as the direction in which the print effective area W is shifted and by the same distance as the distance in which the print effective area W is shifted.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-246715 filed Nov. 10, 2011, which is hereby incorporated by reference herein in its entirety.

What is claimed is:

1. Printing apparatus comprising a light-emitting device array in which plural light-emitting devices are arranged and a photoconductor which moves in a direction perpendicular to a direction in which the light-emitting devices are arranged, in which light emitted by the light-emitting devices exposes the photoconductor to form a print image on the photoconductor, wherein the light-emitting device array includes the light-emitting devices of a number greater than a number of pixels of a single line of the print image, data of the single line of the print image are allocated to a portion of the light-emitting devices in the light-emitting device array and turn-off signals are allocated to remaining light-emitting devices in the light-emitting device array, and in a period in which exposure of the photoconductor is halted after a predetermined time is elapsed or after a predetermined amount of printing is exceeded, the light-emitting devices to which the data of the single line of the print image are allocated are shifted in position in the light-emitting device array in a predetermined sequence or by a random number of pixels.

2. The printing apparatus according to claim 1, wherein the period in which exposure of the photoconductor is halted is a period in which the exposure position of the photoconductor is between two print pages.

3. The printing apparatus according to claim 1, wherein the period in which exposure of the photoconductor is halted is a period in which the exposure position of the photoconductor corresponds to a margin of a print page.

4. The printing apparatus according to claim 1, wherein the period in which exposure of the photoconductor is halted is a period in which the exposure position of the photoconductor corresponds to a blank line in a text.

5. The printing apparatus according to claim 1, wherein:

after the data of the single line of the print image are input to the light-emitting device array by first clock signals, a number of which is equal to the number of pixels of the line of the print image, turn-off signals are input by second clock signals, a number of which is equal to the position shift number of the light-emitting device.

6. The printing apparatus according to claim 1, wherein: data signals of all the light-emitting devices in which turn-off signals are added before and/or after the data of the single line of the print image are generated and input to the light-emitting device array.

7. The printing apparatus according to claim 1, wherein the position of the light-emitting devices to which the data of the single line of the print image are allocated is shifted by two pixels at a time.

8. The printing apparatus according to claim 1, wherein the position of the light-emitting devices to which the data of the single line of the print image are allocated is shifted randomly.

9. The printing apparatus according to claim 1, further comprising a mechanism for changing a position of the light-emitting device array in a direction parallel to the direction in which the light-emitting devices are arranged.

10. The printing apparatus according to claim 1, further comprising a mechanism for changing a position of a paper for printing in the direction parallel to the direction in which the light-emitting devices are arranged.

11. The printing apparatus according to claim 1, wherein the light-emitting device is an organic electroluminescence device.

12. The printing apparatus according to claim 8, wherein the position of the light-emitting devices to which the data of the single line of the print image are allocated is shifted such that the position of the light-emitting devices to which the data of the single line of the print image are allocated distributes by a normal distribution about a central portion of the light-emitting device array.

13. The printing apparatus according to claim 1, wherein:

the portion of the light-emitting devices in the light-emitting device array to which data is allocated is shifted in a first direction by a first distance; and the light-emitting device array is shifted in a second direction opposite to the first direction by the first distance; and a position of a paper for printing is not shifted.

* * * * *